US005737709A

United States Patent [19]

Getty et al.

[11] Patent Number: 5,737,709

[45] Date of Patent: Apr. 7, 1998

[54] HIGH PRESSURE WASHOUT OF EXPLOSIVES AGENTS

[76] Inventors: Heather L. Getty, 6130 Dallas La., Plymouth, Minn. 55446; Paul L. Miller, 18611 Red Cherry Cir., Minnetonka, Minn. 55345; Michael S. Cypher, 10940 95th, Monticello, Minn. 55330; Joseph H. Lamon, R.R. 1, Box 231, Zimmerman, Minn. 55398; David P. Hatz, 17036 Gray's Bay Blvd., Wayzata, Minn. 55391; Millard M. Garrison, 7025 Lanham La., Edina, Minn. 55439; Lonny D. Hill, 19213 Yale St., Elk River, Minn. 55330; Dennis A. Martinson, 8220 Blackbind La., Lino Lakes, Minn. 55014; Ray Elbert Reynolds, 8012 S. 86th E. Ave., Tulsa, Okla. 74113; José P. Munõz, 5380 Mystic Lake Dr., Brighton, Mich. 48116

[21] Appl. No.: 714,825

[22] Filed: Sep. 17, 1996

Related U.S. Application Data

[63] Continuation of Ser. No. 365,661, Dec. 29, 1994, abandoned.

[51] Int. Cl.[6] ..... A62D 3/00; B08B 3/02

[52] U.S. Cl. ..... 588/202; 134/22.12; 134/22.14; 134/23; 134/24

[58] Field of Search ..... 588/202; 149/19.92, 149/199.6; 134/5, 22.12, 22.14, 24, 23

[56] References Cited

U.S. PATENT DOCUMENTS

| | | | |
|---|---|---|---|
| 1,492,905 | 5/1924 | Swanick | 134/5 |
| 1,492,922 | 5/1924 | Knight | 134/5 |
| 4,793,866 | 12/1988 | McIntosh | 134/24 |
| 5,052,624 | 10/1991 | Boers et al. | 239/525 |
| 5,167,721 | 12/1992 | McComas et al. | 134/32 |
| 5,363,603 | 11/1994 | Muller et al. | 451/40 |
| 5,370,845 | 12/1994 | Muller et al. | 422/186.3 |

FOREIGN PATENT DOCUMENTS

| | | |
|---|---|---|
| 2 630 667 | 11/1989 | France . |
| 40 10 757 | 8/1991 | Germany . |
| PCT/US90/02734 | 5/1990 | WIPO . |

*Primary Examiner*—Ngoclan Mai

*Attorney, Agent, or Firm*—Merchant, Gould, Smith, Edell, Welter & Schmidt, P.A.

[57] ABSTRACT

Described is a method of removing explosive agents from the interior of explosive agent filled bodies such as munitions shells. A rotating nozzle is inserted into an opening cut into the shell. Ultra-high pressure fluidjets (i.e. above 40,000 psi) are projected from orifices in the nozzle onto the explosive agent in the shell. Explosive agent and explosive agent laden fluid is contained and carried away from the shell for recycle or disposal.

28 Claims, 3 Drawing Sheets

HIGH PRESSURE WASHOUT OF EXPLOSIVES AGENTS

This is a Continuation of application Ser. No. 08/365,661, filed Dec. 29, 1994, now abandoned.

FIELD OF INVENTION

This invention relates to the demilitarization of munitions. More particularly, this invention relates to use of ultra-high pressure (above 40,000 psi) fluidjet technology for the removal of explosives from the interior of unused military items such as shells and projectiles.

BACKGROUND

As used in this application, demilitarization means the removal of explosives from any type of explosive agent laden military item such as a shell, projectile or rocket. There are currently a number of methods disclosed by the prior art that can be used to demilitarize munitions. For example, steam out and autoclave melt out. These methods, however, cannot be used to remove materials with high melting points or materials which do not melt before they begin ignition.

Use has been made of both cavitating and "high-pressure" (below 20,000 psi) fluidjets in mechanisms that rotate and move transversely in and out of unused military shells to remove the contained material. For example, D. A. Summers et al., *Considerations in the Design of a Waterjet Device for Reclamation of Missile Casings* in Proceedings of the Fourth U.S. Water Jet Conference 51, 52 (The Am. Soc'y of Mechanical Eng'rs, 1987) discusses a "rapidly spinning lance" that moves transversely in and out of a shell. Two nozzles project water onto the contained material at pressures of up to about 20,000 psi. The pressurized water acts as an abrasive, removing the material from the shell's inner surface.

Also, A. F. Conn & S. L. Rudy *Conservation and Extraction of Energy with the Cavijet* in Jet Cutting Technology 19, 28 (Fourth Int'l Symposium on Jet Cutting Technology 1978) discuss an apparatus similar to that described in Summers that uses a cavitating waterjet to scrub the explosive from the interior of un-used military shells. Cavitating fluidjets emit fluid streams in which vapor or gas pockets are suspended. These vapor cavities enhance the abrasive action of the pressurized fluid.

For purposes of demilitarization, however, both cavitating and high pressure (below 20,000 psi) fluidjets have several drawbacks. First, the cavitating waterjet process involves the impact of vapor bubbles on the waterjet's target. Pressures created during the collapse of the vapor bubbles on the target can exceed 1 million psi. These pressures have been thought to create reactions in explosive target material. Thus, the literature has recommended against the removal of explosives using cavitating waterjets.

Second, high pressure (non-cavitating) fluidjets operate at pressures that are not adequate for efficient erosion of materials commonly used as shell fillers. For example, they cannot remove plastic bonded explosives (PBXs) because their shear strength exceeds the energy available. Higher pressure fluidjets (above 40,000 psi) have the energy to remove PBXs (and other high shear strength materials), but it is generally thought that using such high pressure fluidjets in explosive removal can cause explosive reactions.

Third, both cavitating and high-pressure waterjets can use tremendous quantities of water up to 50 gallons/min. The amount of fluid used in the washout process varies directly as the diameter of the fluidjet used. Further, at higher washout fluid pressures, a smaller diameter fluidjet can be used to achieve the same cleanliness and cleaning rate. Thus, at higher pressures, a smaller amount of water may be used and the same (or better) results will be realized. However, as stated above, it is generally thought that impinging ultra-high pressure fluidjets onto explosives can cause explosive reactions.

Fourth, neither steam out, cavitating fluidjet washout nor high pressure (below about 20,000 psi) fluidjet washout can achieve 5X cleanliness required by Army Material Command Regulation 385-5 for explosives and Army Material Command Regulation 385-61 for chemical weapons.

There are also several problems associated with pressurized waterjet washout in general. During the process, material removed from the interior of the shell can accumulate on the exterior of the washout device and interfere with the proper operation of the system. Summers discusses removed material collecting around and possibly blocking the orifices in the washout device. He points out that this could cause failure of water feed hoses and couplings leading to the washout device. Further, material accumulated on other parts of the washout device can cause it to bind in bushings or guides.

Another problem associated with fluid washout of military shells can occur if the fluid coming in contact with the contained material is above the melting point of the material. Heat generated from the kinetic energy of the fluid pressurization and washout is released during the process. This can cause melting of some of the removed material. The locally melted material subsequently re-freezes into ceramic-like globules. These globules interfere with the washout equipment, require further processing, and cause additional cleaning requirements.

Finally, it was discovered that the washout process produces washed out particles of widely varying size; anywhere from tenths of millimeters to tens of centimeters in diameter. Reduction in particle size of explosives is an extremely hazardous process that results in numerous explosions. Further, many of the particles can be large enough to clog piping and filtering systems designed to carry away and recycle particle laden washout fluid.

As a result of all these drawbacks, there is tremendous room for improvement in the field of pressurized fluid washout of military shells. A system is required which possesses a number of characteristics. First, there should be no danger of explosive reaction as has been suggested to exist with cavitating fluidjets. Second, the melting point of the material to be removed should not be a key element as it is for autoclave melt out and steam out. Third, the system should consume less washout fluid, and produce lower amounts of used washout fluid than other washout methods. Fourth, the process should be able to achieve 5X cleanliness. Fifth, a method to remove washed out material solids adhering to the washout device should be provided. Finally, an efficient and safe method to reduce the size of particles produced in the washout process should also be provided.

SUMMARY OF INVENTION

As pointed out above, it is generally thought that use of ultra-high pressure (above about 40,000 psi) fluidjets on explosives presents a danger of explosive reaction. However, experiments of the inventors demonstrate that if both the diameter of the fluidjet stream and type of fluid used are appropriately controlled, minimal danger of reaction of the explosive being removed is encountered.

Two factors are primarily responsible for this result. First, the critical impact velocity necessary for explosive initiation varies as the inverse square root of the diameter of the projectile striking the explosive. Thus, as the diameter of the impinging projectile is reduced, the speed at which the projectile can strike the explosive without causing an explosive reaction increases. Second, it has also been determined that a factor known as the acoustic impedance mismatch between the explosive mass and impinging projectile is important in the initiation of an explosive reaction. For example, the acoustic impedance difference between steel/TNT and water/TNT is a factor of about 3.85. This means that steel is far more likely than water (or a water-like fluid) to initiate an explosive reaction in TNT.

The practical importance of all of this is that fluidjets operating at pressures from about 40,000 to 150,000 psi can be safely used in washout of high explosives providing that the diameter of the washout stream is critically controlled. Empirical studies of the inventors revealed that if water-like fluids are projected through orifices between about 0.001" and about 0.02" in diameter, at pressures above about 40,000 psi, the likelihood of explosive reaction in target materials is no greater than that of lower pressure fluidjets. Further, due to the acoustic impedance mismatch factor, some fluids, such as gasoline, can theoretically be used up to about 600,000 psi.

Accordingly, the present invention is an improved method of removing material from un-used military shells using pressurized fluid washout. In one aspect of the invention, there is provided a method by which a translationally mobile, rotating nozzle mounted at the end of a hollow lance projects fluids at pressures from above about 40,000 psi through orifices ranging from about 0.001" to about 0.020" in diameter, onto material contained at the interior of an unused munition with the object of removing the material. As the material is washed out from the munition, it is collected in a collection vessel and channeled away from the washout site along with the used washout fluid.

In another aspect of the invention, there is provided a method to washout military shells whereby the fluid projected onto the material contained in the munition is chilled below the melting point of the material.

In another aspect of the invention, there is provided a method of removing washed out material adhering to the washout lance. This process uses lance stripper nozzles that focus low pressure (about 50 to about 200 psi) streams of fluid at the surface of the washout lance.

In another aspect of the invention, there is provided a method of reducing the size of material particles removed from the interior of munitions. A particle reduction screen is positioned inside the collection vessel so that the used washout fluid and removed material must pass through the screen before being channeled away from the washout area. The screen is further positioned so that a back-facing, ultra-high pressure washout jet impinges washed out material particles against the screen. In this way, washed out particles that are small enough to pass through the screen do so. Particles that are too large are milled by bombardment against the screen until they are small enough to pass through. The size of the screen mesh is dictated by the maximum size of material particles acceptable to the user. The method is effective for a wide range of desired particle sizes; from a hundredths of millimeters to tens of centimeters.

The washout fluid used in the invention is not limited to a specific type. It may be an erosive agent, a solvent agent, or a combination of both. Useable fluids include: aliphatic hydrocarbons, such as naphtha and hexane; ketones, such as cyclohexanone and acetone; aromatic hydrocarbons, such as toluene and xylene; alcohols, such as ethanol and butanol; glycols, such as ethylene and propylene glycol; esters, such as ethyl acetate and n-butyl acetate; water; aqueous or non-aqueous mixtures of the above listed chemicals; gases that are liquified by pressure, such as propane, butane, and carbon dioxide; gases that are liquified by reduced temperature, such as propane, argon, and nitrogen; and liquified solids, such as microcrystalline wax and low temperature eutectic alloys.

Neither is the invention limited by the type of explosive contained in the body to be cleaned out. Explosives with which the invention will function effectively include: ammonium perchlorate (AP); 2,4,6 trinitro-1,3-benzenediamine (DATB); ammonium picrate (Explosive D); octahydro-1,3,5,7-tetranitro-1,3,5,7-tetrazocine (HMX); nitrocellulose (NC); nitroguanidine (NQ); 2,2-bis[(nitroxy) methyl]-1,3-propanediol dinitrate (PETN); hexahydro-1,3,5-trinitro-1,3,5,-triazine (RDX); 2,4,5-trinitrophenol (TNP); hexahydro-1,3,5-benzenetriamine (TATB); N-methyl N-2,4,6 tetranitrobenzeneamine (Tetryl); 2-methyl-1,3,5-trinitrobenzene (TNT); Amatol (Ammonium Nitrate/TNT); Baratol ($Ba(NO_3)_2$/TNT); black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; and Octol (HMX/TNT).

The above lists of washout fluids and explosives useable with the present invention are not intended to be complete. They are only representative of the materials that can be used with the present invention.

The present invention has a number of distinct advantages over steamout, cavitating fluidjet or high pressure (below 20,000 psi) fluidjet washout methods. First, as discussed above, the use of ultra-high pressure fluidjets projected through appropriately sized orifices presents no danger of explosive reaction.

Second, the kinetic energy of the ultra-high pressure fluid stream is in excess of the shear strength of even plastic bonded explosives (PBXs). Thus, these types of high shear strength materials may be effectively washed out using the method of the present invention.

Third, as opposed to steamout methods, the process is effective when used on explosives and other filler materials with high melting points.

Fourth, as discussed above, using smaller fluidjet stream diameters ultra-high pressure fluidjets can achieve the same results as lower pressure fluidjets while using less fluid. The current invention therefore uses far less fluid and produces far less waste than some lower pressure methods. As stated above, other fluid washout methods can use up to 50 gal./min. of fluid. In contrast, the present invention uses only about 0.05 to about 4 gal./min. of fluid. Finally, the present invention is capable of cleaning a container of explosive agent materials to a level as good or better than that of the required 5-X cleanliness. The cleanliness achieved can also be stated in terms of mass of residual material per unit area. In these terms, the present invention can achieve a cleanliness level of a maximum of 500 micrograms per square inch. At these levels of contamination, the empty projectile casings meet the requirements of the Environmental Protection Agency as being non-hazardous empty containers. None of the existing processes can achieve these results.

Another advantage of the present invention is the use of a chilling means to reduce the temperature of the washout fluid. The washout fluid projected onto the contained material is below the melting point of the material. This ensures that no melting of removed explosive agent occurs and eradicates the problems presented by the presence of resolidified, ceramic-like globules of material in the washout process. No interference with washout equipment is experienced and there is no need for further processing of the removed material.

Another advantage of the current invention is that the use of separate pressurized waterjets focused at the washout device removes the accumulation of explosive agent material. This is accomplished safely and without interfering with either the positioning of the washout device or the simultaneously occurring washout process. It further facilitates free movement of the washout lance through any bushings or guides.

A final advantage of the present invention is that the use of a particle reduction screen reduces the size of removed material particles to whatever diameter is required by the user. This keeps large particles of material from plugging up pumps and plumbing in the processing of removed material. Further, the contained material can be reduced to any size in a manner that is both faster and safer than existing methods. The particle reduction method has the final advantage of not requiring any additional energy or space expenditures; the milling takes place at the site of the washout and uses energy already present in a back-facing fluidjet.

For a better understanding of the invention and advantages of its use, reference should be made to the drawings and accompanying descriptive matter in which there is illustrated and described a preferred embodiment of the invention.

DETAILED DESCRIPTION OF THE INVENTION

Figure 1:
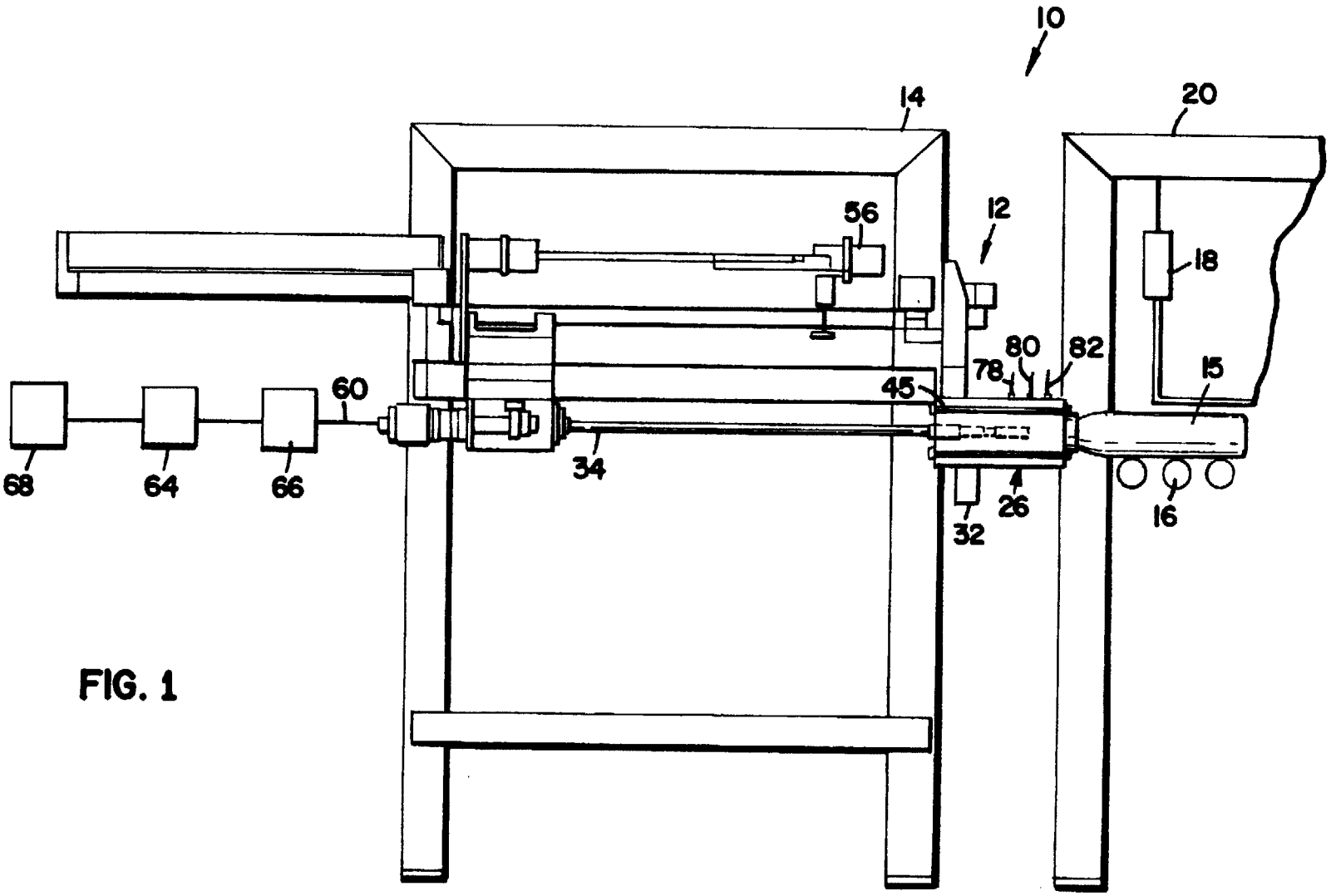
FIG. 1 shows a side view of the washout station.

Referring to FIG. 1, the system for ultra-high pressure washout of explosives or chemical agents is shown generally at 10. The washout apparatus 12 is supported by a frame 14. The explosive or chemical agent filled shell 15 rests on a support 16 and is held in place by a clamp 18. The support 16 and clamp 18 are further supported by a frame 20. Though the present invention can be used with a wide variety of explosive or chemical agent filled bodies, tests of the preferred embodiment were run on 105 mm shells and 155 mm shells.

The collector tee 26 is where washed out material and used washout fluid are collected and channelled away. The collector tee 26 is also where the particle classification screen 30 is located. In the preferred embodiment, the collector tee 26 is primarily a cylinder having an inner diameter of about 5.48", and outer diameter of about 5.73" and a height of about 11.37". The collector tee 26 is constructed of stainless steel. A slurry discharge 32 is located in the lowermost part of the wall of the collector tee 26 to carry washed out explosive or chemical agent and used washout fluid away from the washout site.

Figure 2:
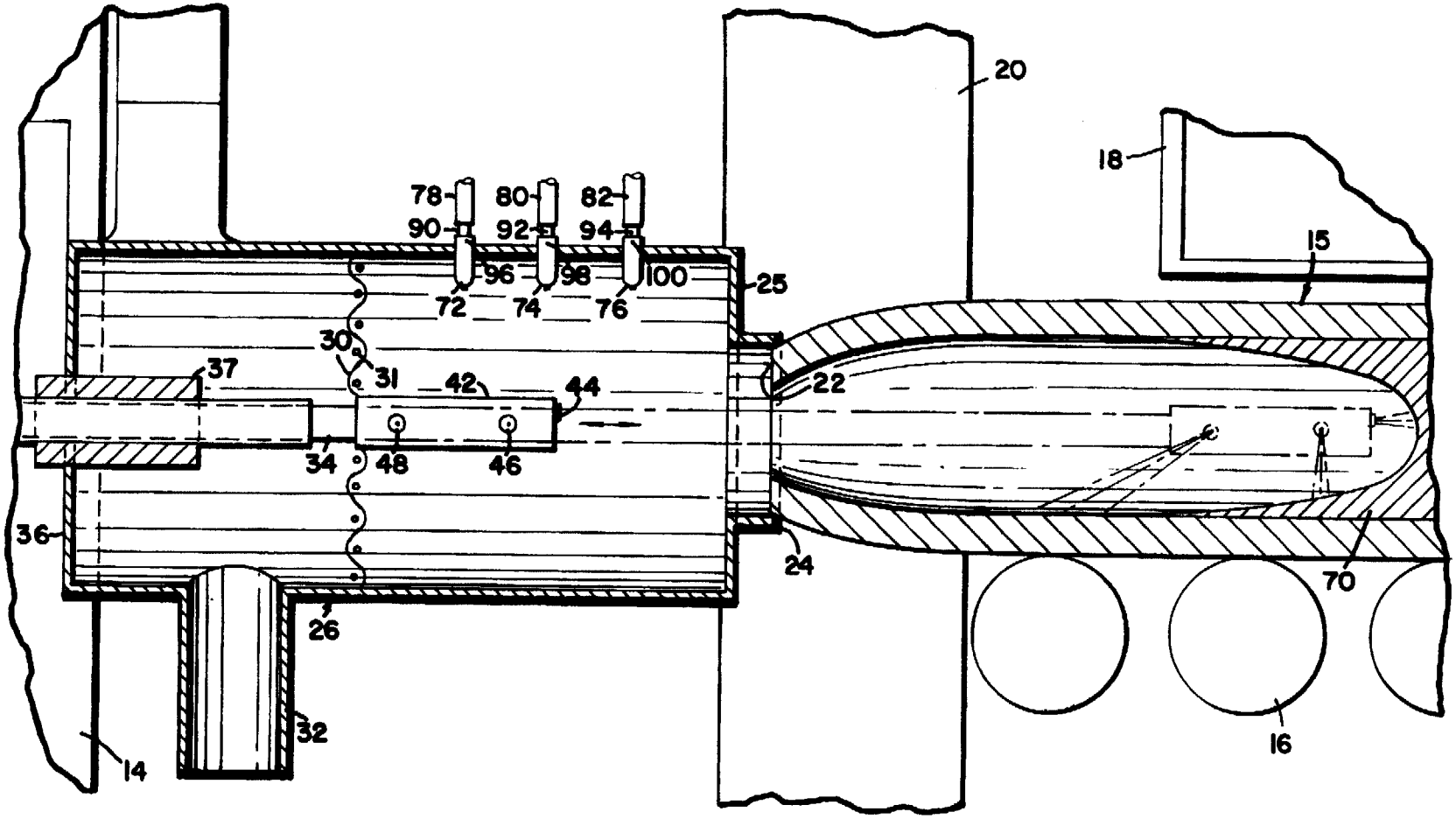
FIG. 2 shows detail of the washout lance, washout nozzle, orifices, lance stripper nozzles and ultra-high pressure fluid streams.

Referring to FIG. 2, shell 15 is cut open at 22. This opening can be cut using any method of cutting explosive bodies well known in the art, such as abrasive waterjet, or may be made by removing a fuse or fill plug. The clamp 18 applies pressure to the shell 15 to hold it in place. The nose seal 24 applies pressure of the collector tee 26 against shell 15. The opening 24 is a circular flange about 2.86" in diameter. The precise diameter of the flange will depend upon the size shell that is being washed out. The flange extends out about 0.8" from the projectile face 25 of the collector tee 26. No O-ring is used in creating the seal because during the washout process, the interior of the collector tee 26 shell 15 combination will be at lower pressure than the exterior. This vacuum acts to prevent leakage.

The washout lance 34 passes through the lance face 36 (the face opposite the projectile face 25) of the collector tee 26. The lance passes through an opening about 0.9" in diameter in the lance face 36 of the collector tee 26 which is fitted with a bushing 37. Inlets for the fluid supplies 78, 80, 82 for the lance stripper nozzles 72, 74, 76 are located in the uppermost wall of the collector tee 26. The collector tee 26 is mounted to the stand 14. The tie rods through the lance face 36 and the projectile face 25 hold the connector tee together. The connector tee is mounted by a flange on top.

In the preferred embodiment, the washout lance 34 is a 3' long, 9/16" piece of high pressure tubing. The washout nozzle 42 is threaded onto the collector tee end of the washout lance 34 and is located inside the collector tee 26. Referring to FIG. 2, three orifices 44, 46, 48, are threaded into the washout nozzle. The orifices 44, 46, 48, can range in diameter from 0.001" to 0.02". In the preferred embodiment, orifice 44, which emits the "pilot" stream, is 0.010" in diameter; orifice 46, which emits the "side" stream, is 0.008" in diameter; and orifice 48, which emits the back stream is 0.006" in diameter. FIG. 2 also shows the directions of the three streams. The orifices are available from commercial suppliers. Those used in the preferred embodiment are fabricated from sapphire or diamond.

The washout lance 34 can remain rotationally stationary or, be rotated anywhere from about 1 to about 700 rpm. Preferably in the range from about 400 to about 600 rpm. The washout lance 34, washout nozzle 42 and orifices 44, 46, 48, can also be moved translationally so that the washout nozzle 42 and orifices 44, 46, 48, move in and out of the shell 15 being washed out. The washout lance 34 and washout nozzle 42 may be moved in and out of the shell 15 at a rate of more than 0 to about 20 inches per minute. In the preferred embodiment, there is no set rate at which the washout lance 34 and washout nozzle 42 are translationally moved. Mechanisms to both rotate and translationally move the washout lance 34 are well known to those skilled in the art.

Figure 3:
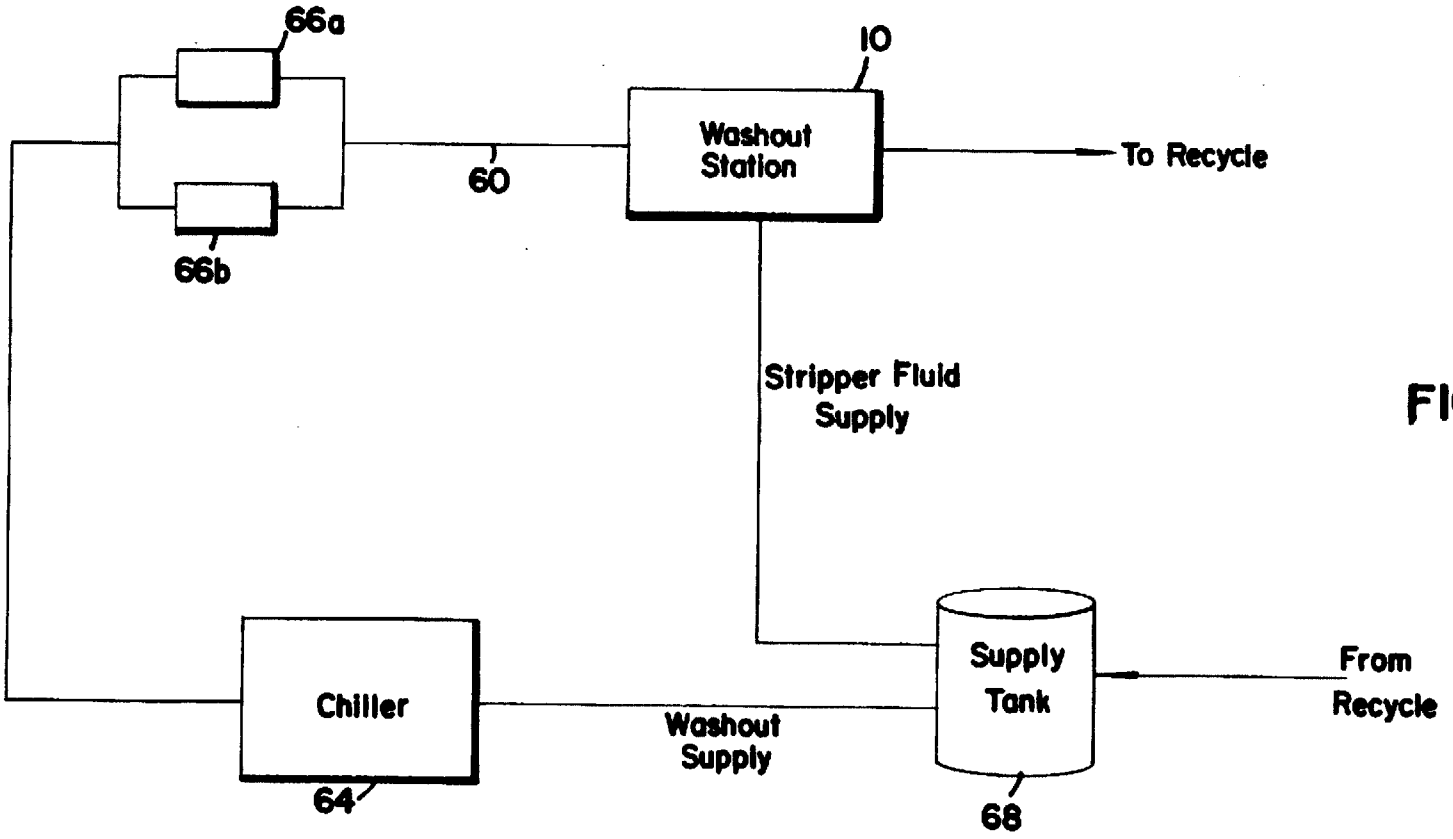
FIG. 3 shows a block diagram of the fluid supply, chiller, intensifier pump and washout station.

The washout fluid is supplied to the washout lance 34 via washout fluid supply pipe 60. Referring to FIG. 3, before being supplied to the washout lance 34, the washout fluid is channeled through a commercial chiller 64 and two parallel commercial intensifier pumps **66*a*, 66*b*. In the preferred embodiment, the intensifier pumps 66*a*, 66*b* are an Ingersoll Rand 50 h.p. streamline II units that pressurize the washout fluid from about 40,000 to about 45,000 psi. The chiller 64 is a FILTRINE model PCP-200A-27, 2 HP compressor, 2 HP pump. The chiller 64 can chill both water and other washout fluids. The temperature of the washout fluid emitting from the chiller 64 is from about 50 to about 55 degrees fahrenheit. In the preferred embodiment, the washout fluid is channeled first through the chiller 64 and then the intensifier pumps 66a, 66b. However, the present invention may also be effected by channeling the washout fluid first through the intensifier pumps 66a, 66b and then the chiller 64. The original washout fluid supply 68** is a surge tank in which washout fluid recycled by an explosive laden water recycle process is being pumped.

Referring to FIG. 2 the particle reduction screen 30 is fixed into the collector tee behind the washout nozzle 42 but forward of the slurry discharge 32. The screen 30 is constructed by drilling 24, 0.125" holes 31 evenly spaced around the perimeter of the collector tee 26. Wire is then threaded through the holes so as to create a mesh. The holes are sealed with silicon and clamped with a pipe clamp (not shown). So placed, washout fluid and washed out material must pass through the screen to be further processed. In the preferred embodiment, the mesh in the particle classification screen 30 is about 0.5" in diameter. Thus, washed out particles having a diameter smaller than 0.5" pass through the screen 30 while particles having a larger diameter do not. Washout fluid emitting from the back stream orifice 48 causes washed out material particles not passing through the screen 30 to be bombarded into the screen 30. This bombardment reduces the size of the particles until they are able to pass through the holes in the particle classification screen 30. Thus, no particles greater than 0.5" in diameter pass out of the washout station. Further, the bombardment of the back stream eventually reduces all the material removed from the shell 15 to a size able to pass through the screen 30; no removed material is left in the collector tee 26 or shell 15. Finally, no additional energy is spent in reducing the particle sizes of the removed material.

During the process of removing the material 70 from the shell 15, removed material accumulates on the washout lance 34. To alleviate this problem, referring to FIG. 2, lance stripper nozzles 72, 74, 76 are installed in the uppermost side of the collector tee 26. In the preferred embodiment, the fluid projected through the lance stripper nozzles 72, 74, 76 is supplied from the same supply tank 68 as fluid for the washout process. The lance stripper nozzles 72, 74, 76 project fluid onto the washout lance 34 at about 60 to about 200 psi. Fluid is supplied to the lance stripper nozzles 72, 74, 76 via the lance stripper nozzle fluid supplies 78, 80, 82 which are constructed from ¼" diameter flexible hosing. The connections for the fluid supplies 78, 80, 82 are two barb NPT connectors 90, 92, 94 threaded into cylindrical receptacles 96, 98, 100 welded into the uppermost wall of the collector tee 26.

EXAMPLES

Example 1

TNT was washed out of a 105 mm projectile. The front of the washout nozzle was placed at a starting point 5" from the projectile mouth. The washout nozzle was advanced at a rate of 4"/min. and stopped at a distance of 1.5" from the projectile inside bottom. The nominal washout water pressure used was 42,000 psi. The washout nozzle was rotated at 400 RPM. The washout process used 0.88 gallons per minute of water. The water was cooled to 47 degrees fahrenheit before entering the intensifier pump. The diameters of the orifices used were as follows: pilot stream, 0.010"; side stream, 0.008"; back stream, 0.006". The results were a shell interior and washout lance that were entirely clean. The washout nozzle and projectile mouth seal surface, however, had some TNT buildup.

Example 2

All parameters for example 2 are the same as those for example 1 except that Octol, rather than TNT was the removed material, and the washout nozzle was advanced at a rate of 2.4 inches per minute. The results were a projectile, washout nozzle and washout lance that were all clean. There was some residual Octol, however, on the projectile mouth seal surface.

Though numerous characteristics and advantages of the invention have been set forth in the foregoing description, together with the details of the structure and function of the invention, the disclosure is illustrative only. Changes may be made in detail, especially in matters of shape, size, arrangement of parts and ranges of variable parameters, within the principles of the invention, to the full extent indicated by the broad, general meaning of the appended claims.

We claim:

1. A method for the removal of explosives from explosive from explosive agent filled bodies comprising:

(a) supplying fluid from a fluid supply means;

(b) pressurizing the fluid to ultra-high pressures using a pressurizing means which pressurizes the fluid to more than about 40,000 psi;

(c) projecting the fluid onto the explosive agent contained in the explosive agent filled body using a directing means whereby the explosive means inserted or withdrawn at the rate of more than 0 to about 200 inches/minute whereby the explosive agent is removed from the interior of the body;

the directing means having a hollow lance, a nozzle and a plurality of orifices through which the fluid is projected, each of the plurality of orifices having a diameter in the range of about 0.001" to about 0.020".

2. The method of claim 1 wherein the fluid comprises:

aliphatic and aromatic hydrocarbons, ketones, alcohols, glycols, esters, water and mixtures thereof, liquified gases, or liquified solids.

3. The method of claim 2 wherein the fluid comprises:

toluene, naphtha; ethylene or propylene glycol; hexane; cyclohexane; acetone; ethanol; butanol; ethyl acetate; n-butyl acetate; liquified carbon dioxide, argon or nitrogen; or liquified microcrystalline wax or eutectic alloys.

4. The method of claim 1 comprising the additional step of inserting the directing means into the explosive agent filled body along a rotational axis of symmetry of the body, and rotating either the directing means or the body about the rotational axis of symmetry along which the directing means is inserted.

5. The method of claim 4 wherein either the explosive agent filled body or the directing means is rotated at a rate of about 50 to about 10,000 rpm.

6. The method of claim 1 comprising the additional step of chilling the fluid by use of a chilling means to at least below the melting point of the explosive agent contained in the body.

7. The method of claim 1 comprising the additional step of stripping the hollow lance of removed explosive agent accumulated thereon using a lance stripper means in which a plurality of lance washer nozzles project a fluid onto the outer surface of the hollow lance at a pressure high enough so as to remove accumulated explosive agent from the outer surface of the hollow lance.

8. The method of claim 7 wherein the lance stripper means removes accumulated explosive agent from the outer surface of the hollow lance simultaneously with the removal explosive agent from the explosive agent filled body.

9. The method of claim 7 wherein the lance stripper means projects a fluid onto the outer surface of the hollow lance at pressures between about 50 and about 200 psi.

10. The method of claim 1 comprising the additional steps of collecting and channeling away washed out explosive agent and used washout fluid using a fluid collection means having an enclosure to contain and collect used washout fluid and removed explosive agent, an inlet to allow used washout fluid and removed explosive agent to enter the enclosure, and an outlet to allow used washout fluid and removed explosive agent to be channeled away from the washout area.

11. The method of claim 10 comprising the additional step of reducing the size of particles of removed explosive agent using a particle reduction screen located at the interior of the fluid collection means;

the stream of fluid passing through an orifice causing removed explosive agent to impact the particle reduction screen such that removed explosive agent particles smaller than the openings in the screen pass through the screen, and removed explosive agent particles larger than the openings in the screen are reduced in size until the particles are small enough to pass though the screen.

12. A method for the removal of explosive agent from explosive agent filled bodies comprising:

(a) supplying fluid from a fluid supply means;

(b) pressurizing the fluid to ultra-high pressures using a pressurizing means which pressurizes the fluid to more than about 40,000 psi;

(c) chilling the fluid by use of a chilling means to a temperature at least below the melting point of the explosive agent to be removed;

(d) inserting a directing means into the explosive agent filled body along a rotational axis of symmetry of the body;

(e) rotating either the directing means or the body about the rotational axis of symmetry of the body along which the directing means was inserted;

(f) projecting the fluid onto the explosive agent contained in the explosive agent filled body using the directing means whereby the explosive agent is removed from the interior of the body;

the directing means having a hollow lance, a nozzle and a plurality of orifices through which the fluid is projected, each of the plurality of orifices having a diameter in the range of about 0.001" to about 0.020"; and (g) stripping the directing means of removed explosive agent accumulated thereon using a stripper means in which a plurality of washer nozzles project a fluid onto the outer surface of the directing means at a pressure high enough so as to remove accumulated explosive agent from the outer surface of the directing means.

13. The method of claim 12 wherein the fluid comprises:

aliphatic hydrocarbons, ketones, alcohols, esters, water and mixtures thereof, liquified gases, or liquified solids.

14. The method of claim 13 wherein the fluid comprises: toluene, naphtha; ethylene or propylene glycol; hexane; cyclohexane; acetone; ethanol; butanol; ethyl acetate; n-butyl acetate; liquified carbon dioxide, argon or nitrogen; or liquified microcrystalline wax or eutectic alloys.

15. The method of claim 12 wherein three orifices are fixed into the nozzle;

the first orifice being fixed in the end face of the nozzle;

a second orifice being fixed in one of the sides of the nozzle;

a third orifice being fixed in one of the sides of the nozzle.

16. The method of claim 12 wherein the directing means is inserted or withdrawn from the explosive agent filled body at a rate of more than 0 to 200 inches/minute.

17. The method of claim 12 wherein the rotating of either the explosive agent filled body or the directing means is at a rate of about 50 to about 10,000 rpm.

18. The method of claim 12 wherein the stripper means removes accumulated explosive agent from the outer surface of the directing means simultaneously with the removal of explosive agent from the explosive agent filled body.

19. The method of claim 12 wherein the lance stripper means projects a fluid onto the outer surface of the hollow lance at pressures between about 50 and about 200 psi.

20. The method of claim 12 further comprising the additional steps of collecting and channeling away removed explosive agent and used washout fluid using a used fluid collection means having an enclosure to contain and collect used washout fluid and removed explosive agent, an inlet to allow used washout fluid and removed explosive agent to enter the enclosure, and an outlet to allow used washout fluid and removed explosive agent to be channeled away from the washout area.

21. The method of claim 12 comprising the additional step of reducing the size of removed explosive agent particles using a particle reduction screen located at the interior of the fluid collection means;

the stream of fluid passing through the third orifice causing removed explosive agent to impact the particle reduction screen such that removed explosive agent particles smaller than the openings in the screen pass through the screen, and particles larger than the openings in the screen are reduced in size until the particles are small enough to pass though the screen.

22. A method for the removal of explosive agent from explosive agent filled bodies comprising:

(a) supplying fluid from a fluid supply means;

(b) pressurizing the fluid to ultra-high pressures using a pressurizing means which pressurizes the fluid to above about 40,000 psi;

(c) chilling the fluid by use of a chilling means to a temperature below the melting point of the explosive agent to be removed;

(d) inserting a directing means into the explosive agent filled body along a rotational axis of symmetry of the body;

(e) rotating either the directing means or the body about the rotational axis of symmetry of the body along which the directing means is inserted, the directing means comprised of a hollow lance, nozzle and a plurality of orifices, the nozzle being attached to one end of the hollow lance such that fluid passing through the interior of the hollow lance may pass into the interior of the nozzle, the nozzle having an end face and sides into which the orifices are fixed, such that the fluid at the interior of the nozzle may pass through the orifices to the exterior of the nozzle, each of the plurality of orifices having a diameter from about 0.001" to about 0.020";

(f) projecting the fluid onto the explosive agent contained in the explosive agent filled body using the directing means whereby the explosive agent is removed from the interior of the body, (g) stripping the hollow lance of removed explosive agent accumulated thereon using a lance stripper means in which a plurality of lance washer nozzles project a fluid onto the outer surface of the hollow lance at a pressure high enough so as to remove accumulated explosive agent from the outer surface of the hollow lance;

(h) collecting and channeling away removed explosive agent and used fluid using a used fluid collection means having an enclosure to contain and collect used washout fluid and removed explosive agent, an inlet to allow used washout fluid and removed explosive agent to enter the enclosure, and an outlet to allow used washout fluid and removed explosive agent to be channeled away from the washout area; and (i) reducing the size of particles of removed explosive agent using a particle reduction screen located at the interior of the fluid collection means;

the stream of fluid passing through one or more of the plurality of orifices causing removed explosive agent to impact the particle reduction screen such that particles smaller than the openings in the screen pass through the screen, and removed particles larger than the openings in the screen are reduced in size until the particles are small enough to pass though the screen.

23. The method of claim 22 wherein the fluid comprises:

aliphatic hydrocarbons, ketones, alcohols, esters, water and mixtures thereof, liquified gases, or liquified solids.

24. The method of claim 23 wherein the fluid comprises:

toluene, naphtha; ethylene or propylene glycol; hexane; cyclohexane; acetone; ethanol; butanol; ethyl acetate; n-butyl acetate; liquified carbon dioxide, argon or nitrogen; or liquified microcrystalline wax or eutectic alloys.

25. The method of claim 22 wherein the directing means is inserted or withdrawn from the explosive agent filled body at a rate of more than 0 to about 200 inches/minute.

26. The method of claim 22 wherein the rotating of either the explosive agent filled body or the directing means is at a rate of about 50 to about 10,000 rpm.

27. The method of claim 22 wherein the lance stripper means removes accumulated explosive agent from the outer surface of the hollow lance simultaneously with the removal of explosive agent from the body.

28. The method of claim 22 wherein the lance stripper means projects a fluid onto the outer surface of the hollow lance at pressures between about 50 and about 200 psi.

* * * * *